United States Patent [19]

Colamussi et al.

[11] 4,252,461

[45] Feb. 24, 1981

[54] MANEUVERABLE DAM

[75] Inventors: Arturo Colamussi; Vittorio Merli, both of Ferrara, Italy

[73] Assignee: Pirelli Furlanis Applicazioni Idrauliche, Milan, Italy

[21] Appl. No.: 60,472

[22] Filed: Jul. 25, 1979

[30] Foreign Application Priority Data

Jul. 28, 1978 [IT] Italy ..... 9019 A/78

[51] Int. Cl.[3] ..... E02B 7/20

[52] U.S. Cl. ..... 405/115; 405/64; 405/91

[58] Field of Search ..... 405/87, 91, 107, 115, 405/64

[56] References Cited

U.S. PATENT DOCUMENTS 495,788 4/1893 Debarle ..... 405/115

3,355,896 12/1967 Price ..... 405/91

3,974,655 8/1976 Halpern et al. ..... 405/87

*Primary Examiner*—David H. Corbin

*Attorney, Agent, or Firm*—Stevens, Davis, Miller & Mosher

[57] ABSTRACT

A dam for a waterway comprises a plurality of panels of flexible and inextensible sheet material such as rubberized fabric extending vertically from the bottom to adjacent the surface of a waterway. The edges of the panels overlap and are removably fastened together to provide a series of attached panels which extends across the waterway. Each sheet is attached to a separate concrete base on the bottom of the waterway and to a separate floating cylindrical member ajdacent the surface of the water. Each panel can be repaired or replaced independently of the other panels.

5 Claims, 4 Drawing Figures

FIG. 1
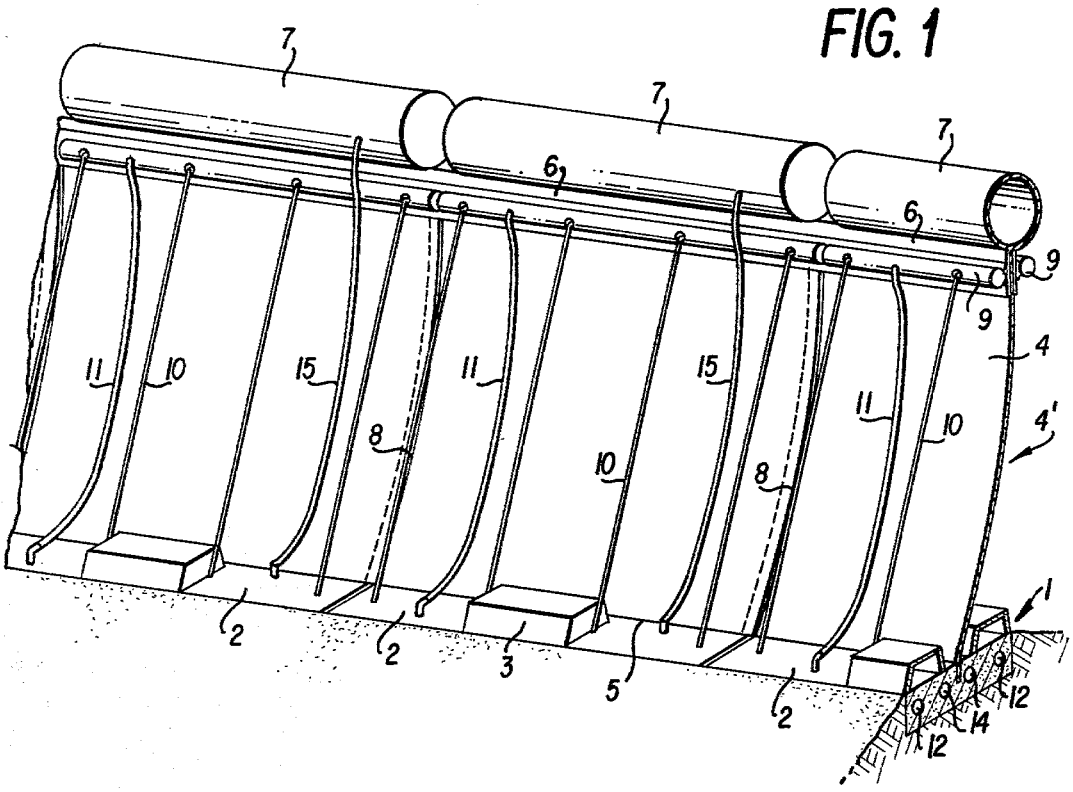
FIG. 2
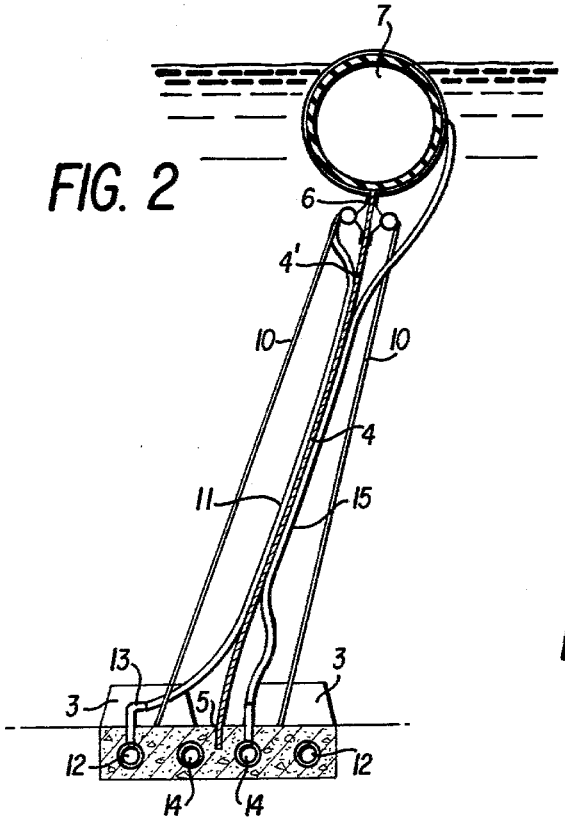
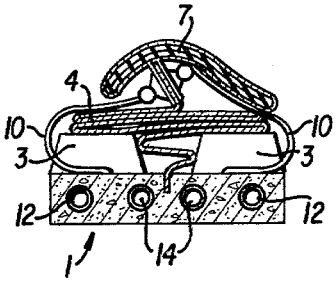
FIG. 3
FIG. 4
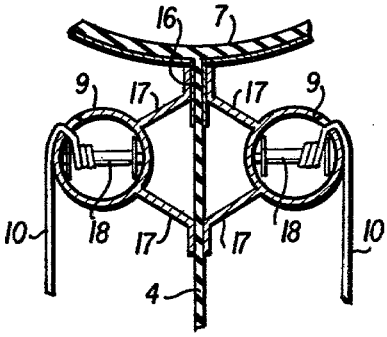

MANEUVERABLE DAM

This invention relates to a maneuverable dam, and more particularly, to a dam that is formed from a sheet of flexible and inextensible materal, such as, for example, a rubberized fabric that is anchored along one of its edges to the bottom of a waterway and with the opposite edge provided with means for raising the sheet and for collapsing it at the bottom of the waterway.

Generally speaking, maneuverable dams made from a rubberized fabric are usually employed for creating a difference in water levels between two basins which are in communication with one another; or for creating a barrier against any passage of liquid, for example, water between two basins.

In the last mentioned case, the maneuverable dams are never found under conditions where they must sustain large differences in levels of the water upstream and downstream of the dam as occurs, for example, when it is required to guarantee protection against the "saline wedge" (formed in correspondence of the river mouth and the open sea) returning back upstream; or else, when it is required to prevent any passage of water that contains suspended material, in certain river zones, where such material can rapidly settle to the bottom.

The "known" dams of the described type, i.e., dams formed of a rubberized fabric anchored to the bottom of the waterway along one edge, and with the opposite edge adapted to be moved away from, or brought into contact with the bottom, present various drawbacks, such as the following:

(a) The "known" dams, in their collapsed state, i.e., with the rubberized fabric laid onto the bottom of the waterway, are difficult to free from sediment accumulated on them when the time comes for the dams to be raised.

(b) The "known" dams are difficult to install and these difficulties become insurmountable when the sheet increases in dimensions beyond a certain value.

(c) The "known" dams require a very complex and heavy anchorage system for fixing them to the bottom of the waterway.

(d) The "known" dams are subject, under certain working conditions, to suffer from considerable fatigue stresses, and hence, they require frequent inspection, maintainance and adjustment.

An object of the present invention is to overcome the above-described drawbacks found in the "known" maneuverable dams made from rubberized fabrics having one edge fixed to the bottom of the waterway, and an opposite edge that is movable away from or towards the bottom of a waterway.

Other objects will become apparent from the following description with reference to the accompanying drawing wherein:

FIG. 1 illustrates, in a perspective view, partially cut away, one embodiment of a maneuverable dam provided by the invention;

FIG. 2 illustrates, in section, the embodiment of FIG. 1 in its raised state, the section being executed in a direction perpendicular to the larger dimension of the dam;

FIG. 3 illustrates, in sectional view, the embodiment of FIG. 2 in its collapsed state, the sectional view being executed in the direction perpendicular to the larger dimension of the dam; and FIG. 4 is an enlarged view of a detail of the embodiment of FIGS. 1 and 2.

The foregoing objects and others are accomplished in accordance with this invention, generally speaking, by providing a maneuverable dam formed by a series of side-by-side panels of flexible and inextensible sheet material fastened together at their overlapping edges and secured at the bottom of the waterway to its own separate concrete slab and secured along its top edge to an inflated floating tubular member.

As shown in FIGS. 1, 2 and 3, one embodiment of the maneuverable dam provided by the invention has a base 1 formed by a plurality of concrete slabs 2 placed side-by-side and resting on the bottom of the waterway or watercourse. A plurality of box-like bodies 3 are mounted on slabs 2. A sheet of flexible and inextensible rubberized fabric extends between slabs 2 and a floating inflated cylindrical member 7. In other words, a sheet 4' of a plurality of side-by-side panels 4, of rubberized fabric spans the space between slabs 2 and cylindrical member 7. Panel 4 is fixed to slabs 2 by means of clamps all along one of its edges (not shown). All of these side-by-side panels 4, taken as a whole, constitute the sheet 4'.

At the edge 6 of each panel 4, i.e., at the edge opposite to the bottom edge 5, by which the panels 4 form a single body with the base formed by slabs 2, cylindrical member 7 inflated with a pressurized gas is disposed. Cylindrical member 7 has its wall formed of a casing made from a flexible and inextensible rubberized fabric. The connection between the cylinder 7 and the panels 4, will be described in more detail hereinafter.

Adjacent panels 4 have their side edges 8 overlapping and joined together. The connection between the side edges 8 of two adjacent panels 4 is effected by means of eyelets (not shown) that are present on the border of one panel 4 and corresponding slip-knots (not shown) attached to the border of the other adjacent panel 4. While the two borders of the panels 4 are overlapping, the slip-knots are inserted into the eyelets and held there in such a way to fasten together the two adjacent panels 4.

In correspondence of the joining zone between panels 4 and the cylinders 7, a pair of tubes from which depart two series of ropes 10 of a variable length which connect tubes 9 to the base 1, and more particularly to the slabs 2 of base 1. This connection between the ropes 10 and the tubes 9 will be described in more detail further on.

The tubes 9, belonging to the adjacent panels 4, are connected to one another, and tubes 9 are connected by means of flexible hoses 11, to conduits 12 incorporated in the base 1. Hoses 11 are preferably secured at points to the panels 4. In conduits 12 there is present pressurized water of a higher pressure than that of the maximum pressure of water of the water-head over the base 1. A plurality of nozzles 13 are provided on conduits 12.

Still on the base 1, there are provided conduits 14 inside of which there is present air under pressure. Hoses 15 which emerge from the base 1 are preferably secured at spaced points to the panels 4 and are connected at their upper end to cylinders 7.

As stated above, the cylinders 7 are secured to the panels 4 along edges 6. Longitudinally slit tubes 9 house reels 18 on which ropes 10 are wound. Ropes 10 extend out of the tubes 9 through the longitudinal slits as shown in FIG. 4.

Also shown in FIG. 4, a pair of tapes or tongues 16 are connected to the external surface of cylinder 7 in correspondence of two adjacent generatrixes. Tapes or tongues 16 extend from the surface of cylindrical member 7 in a cantilever fashion.

Between these two tapes or tongues 16, the edge of the panel 4 is interposed along edge 6. Tapes 16 are connected to the panel 4 by means of bolts (not shown).

To each face of the panel 4 along the edges 6, a rigid tube 9 is disposed. A pair of protuberances or brackets 17 are connected to the surfaces of panel 4.

Inside tubes 9 there are housed a plurality of reels 18 which are rotatably mounted around their axis against the resistence of a spring (not shown). To each reel there is fixed one extremity of the rope 10; whereas the other end of each rope 10 is fixed to the base 1. The ropes are wound or unwound by the reels 18.

The maneuvering operation of the dam, according to the present invention, takes place as follows.

Starting from its raised position (shown in FIG. 2), in order to collapse the dam, the air under pressure in cylinder is expelled. This operation causes these cylinders to collapse, and they are no longer in a condition to support the edges 6 of the panels 4 separating the sheet 4' from the bottom of the waterway.

As a result of this and because of loss of air pressure inside cylindrical members 7, i.e., as the cylindrical members 7 gradually collapse, cylindrical members 7 gradually draw closer to the base 1. Simultaneously, panels 4 gradually draw closer to the base 1.

During this operation in which the panels 4 move closer to the base 1, the ropes 10 (that are to be found on both faces of the panels 4) are reduced in length by winding them on reels 18. Reels 18 are rotated by a loaded spring connected to them and disposed inside the tubes 9. Movement of panels 4 closer to the base 1 is thus guided and sheet 4' is guided to the base 1 by inducing the sheet to gather itself up, inside the spaces between the box-like bodies 3 placed at the base 1.

At the end of this collapsing operation of the cylinder 7, the dam is disposed in a completely collapsed state, as can be seen in configuration represented in FIG. 3.

Starting from the collapsed condition of the dam in order to raise the dam again, pressurized air is introduced inside the cylinders 7, which cylinders, in drawing the edges 6 of the panels 4 upwards, raise the panels 4 from the bottom, and hence, raise the sheets 4'.

In the course of this operation, the ropes 10 lengthen as they are unwound from reels 18 by overcoming the resistence of the spring that is incorporated in the reels (the spring being thus loaded).

From the preceding description, it can easily be understood now that an important element of the dam provided by the present invention is the means for allowing the sheets 4' to refold over themselves, i.e., once the cylindrical member 7 has been made to collapse, so that any eventual formation of sediment taking place, when the dam is in a collapsed state at the bottom of the waterway does not cover the large surface of the sheet forming the dam, as would be the case if the dam were to be allowed to sink to the bottom (without the collecting device being present), owing to the currents in the waterway. As can be understood, with a dam of the type provided by the present invention, even sediment of a considerable thickness might cover the collapsed dam but not interfere with the raising operation of the dam.

The type of collecting-device system described above, comprising a plurality of ropes of variable lengths that are wound around a series of reels that are lodged inside the tubes 9 fixed in correspondence of the cylinder-panel union must not be taken in the limited sense, because similar elements, such as elastic ropes, may also be used provided that they are adapted for serving the same function. In particular, the described collecting-device system prevents particles in suspension, from jamming the mechanisms and/or abrading the ropes, because the tube that houses these ropes is always filled with water at a pressure that is higher than that of the water found outside the tubes.

As a further safeguard against sedimentation, the nozzles 13 connected to the tube system cause the water to flow at a high velocity towards the base of the dam thus flushing out the sediment.

Finally, because the dam is formed of a plurality of adjacent panels 4, with each panel fixed to its slab 2, and each panel 4 being provided with its own cylindrical support member 7, complete substitution of any of one of the elements forming the dam can be made without interfering with the functioning of the dam as a whole.

Moreover, the dam of the present invention, presents the following advantages.

(1) The dam has the capacity of being self-adapting even in the event of great variations in the rise of the water level, by maintaining practically constant difference in levels between the upstream and downstream sides of the dam (though of a modest entity), without requiring constant regulation.

In fact, an increase in the rise of the water, translates into an increase in the levels above and below the dam, and in an increase in the forces which the dam must withstand. These facts determine a diverse immersion of the floating cylinders, until they are submerged. This permits having a high grade of reliability even in cases of maneuvering errors.

(2) The small difference in levels (differences between upstream and downstream sides of the dam) that the dam, according to the invention is called to sustain, induces upon the rubberized fabric very low stresses which permit the use of lightweight and relatively inexpensive structures for the dam.

(3) The dam allows for the passage of boats, with the provision being that certain compound elements of the dam have a lower pre-established height than the surface of the water.

(4) Each component element of the dam can be put into place with relative simplicity through an operation from an appropriate floating stage; in this manner, reducing the underwater operations that would be required for connecting the panels and the hoses to the base.

Although the invention has been described in detail for the purposes of illustration, it is to be understood that such detail is solely for the purpose of illustration and that variations can be made therein without departing from the spirit and scope of the invention except as it may be limited by the claims.

What is claimed is:

1. A maneuverable dam comprising a sheet of flexible and inextensible material anchored along one of its edges to a base fixed into the bottom of the waterway and on its opposite edge provided with an expandable and collapsable cylinder acting as a means for raising and collapsing the dam, a plurality of ropes disposed along the both surfaces of the sheet and connected at one end to the base, while at the other end said ropes are connected to reels bound to the edge of the sheet where the collapsing cylinder is connected on which the ropes wind and unwind during the maneuvering of the dam whereby when the expandable and collapsable cylinder is collapsing and the sheet is lowering on the bottom, the ropes winding again on the reels act as guides for the collapsing sheet.

2. The dam of claim 1 wherein the means for moving the sheet comprises a plurality of expansible and collapsible cylinders.

3. The dam of claim 1 wherein the reels are enclosed in tubes containing water under pressure, said tubes being provided with slits for the passage of ropes.

4. The dam of claim 1 wherein the said sheet of flexible and inextensible material comprises a plurality of side-by-side panels, each panel having its lower edge anchored to the bottom of the waterway and a floating cylindrical member secured to its upper edge, the other two edges of each said panel overlapping the edges of the adjacent panels and secured thereto.

5. A maneuverable dam for a waterway having a bottom, said dam comprising a flexible sheet-like member disposed transversely to the flow of water across the waterway, said sheet-like member comprising a plurality of flexible side-by-side overlapping panels, means joining the overlap of adjacent panels together, means for anchoring each panel independently to the said bottom, means floating on the water attached to each panel independently of the other panels to dispose the panel vertically from its said anchor to adjacent the water surface, means for introducing a fluid under pressure into said floating means to impart buoyancy to said floating means, means for moving the sheet-like member to and fro with respect to said bottom comprising ropes and reels, and means on said bottom for storing surplus panel as the floating means moves towards said anchoring means and thereby limit the area of the surface of the panel which is exposed for accumulation of sediment while the dam is collapsed.

* * * * *